US006561601B1

(12) United States Patent
Maffeo

(10) Patent No.: US 6,561,601 B1
(45) Date of Patent: May 13, 2003

(54) QUICK-ASSEMBLY STORAGE UNIT

(75) Inventor: Anthony A. Maffeo, East Haven, CT (US)

(73) Assignee: Platt and LaBonia Company, North Haven, CT (US)

( * ) Notice: Subject to any disclaimer, the term of this patent is extended or adjusted under 35 U.S.C. 154(b) by 0 days.

(21) Appl. No.: 10/062,705

(22) Filed: Jan. 31, 2002

Related U.S. Application Data

(60) Provisional application No. 60/277,299, filed on Mar. 20, 2001.

(51) Int. Cl.[7] ..... A47B 47/00
(52) U.S. Cl. ..... 312/257.1; 312/263
(58) Field of Search ..... 312/257.1, 263, 312/265.5, 265.6, 326, 329, 108, 111, 351

(56) References Cited

U.S. PATENT DOCUMENTS 2,424,217 A * 7/1947 Bales ..... 312/257.1
2,773,729 A * 12/1956 Derman ..... 312/257.1
3,186,782 A * 6/1965 Ullman, Jr. ..... 312/263
3,856,374 A * 12/1974 Christen ..... 312/263

FOREIGN PATENT DOCUMENTS

FR 910438 * 6/1946 ..... 312/257.1

* cited by examiner

*Primary Examiner*—James O. Hansen
(74) *Attorney, Agent, or Firm*—Raymond A. Nuzzo

(57) ABSTRACT

A quick-assembly storage unit comprises a back panel, a pair of side panels, a top panel, a bottom panel and at least one shelf member. In one embodiment, the unit includes door panels that are hingedly attached to the side panels. The back, side, top, and bottom panels are each configured to have a particular structure that provides a tight-fitting relationship between all interconnecting panels. Each of the shelf members are configured to have a particular structure that provides a tight-fitting relationship between each shelf member and the side panels and between each shelf member and the back panel. The structure and interconnection of the back, side, top, and bottom panels and shelf members provide the quick-assembly storage unit with a relatively high degree of structural integrity. The quick-assembly storage unit can be quickly assembled by the end user or consumer with a minimal amount of tools.

10 Claims, 15 Drawing Sheets

12
100
106
106
200
105
104
104
200
106
104
96
105
200
106
105
92
104
102
150
150
106
94
104
105
98
200

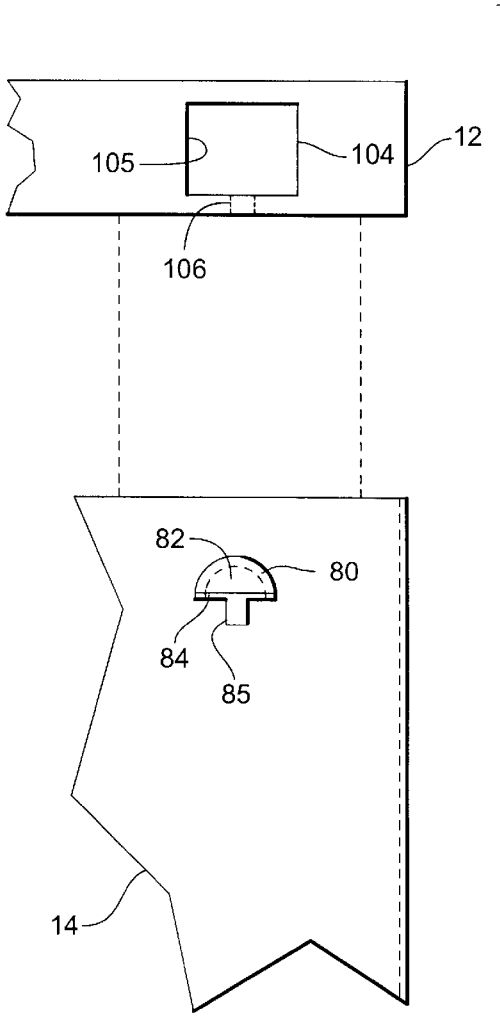
Fig. 5A
Fig. 5B
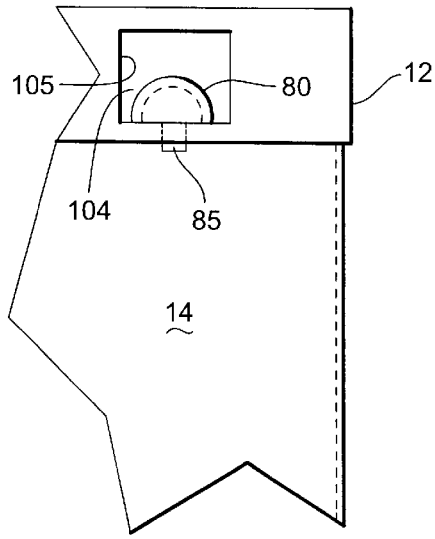

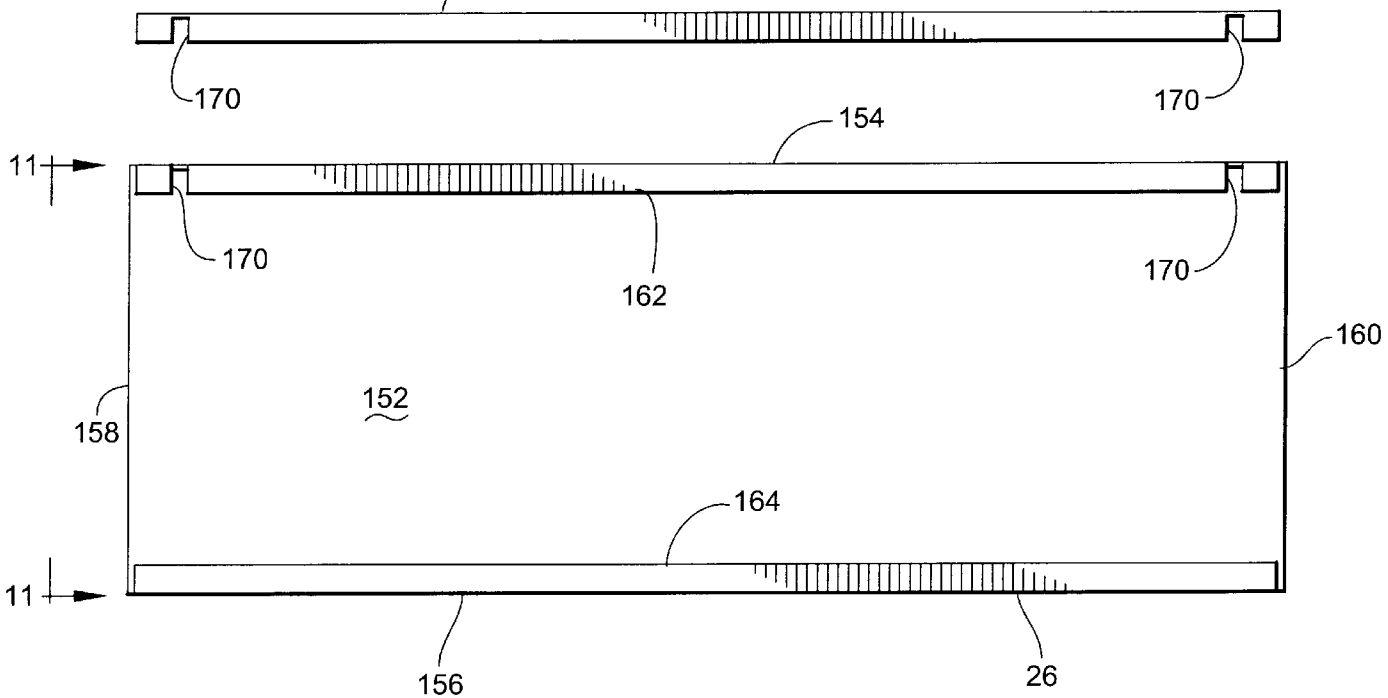
Fig. 10
Fig. 9
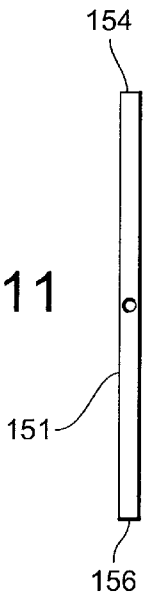
Fig. 11

QUICK-ASSEMBLY STORAGE UNIT

CROSS-REFERENCE TO RELATED APPLICATION

This application claims priority to commonly owned and co-pending U.S. provisional patent application Ser. No. 60/277,299, filed Mar. 20, 2001.

BACKGROUND OF THE INVENTION

1. Field of the Invention

The present invention generally relates to quick assembly storage unit such as a storage cabinet or container.

2. Problem to be Solved

Storage units such as cabinets have many industrial, commercial and residential uses. Typically, conventional storage cabinets are first assembled at the manufacturing location and then shipped to the end buyer or consumer. However, such a practice creates several problems. First, since the cabinet is being shipped fully assembled, it occupies a significant amount of space on the carrier's delivery vehicle or plane. The same problem would occur if rail is used to ship the assembled cabinets. Furthermore, shipping the fully assembled storage cabinets requires large-sized shipping cartons or packaging thereby further increasing the overall shipping costs. What is needed is a storage cabinet that can be shipped in a disassembled state so as to reduce shipping costs and shipping time, and be then quickly assembled by the consumer or end user.

SUMMARY OF THE INVENTION

The present invention is directed to a quick-assembly storage unit. In one embodiment, the quick-assembly storage unit comprises a back panel, a pair of side panels, a top panel, a bottom panel and at least one shelf member. The back panel has a front side, back side, a pair of flanged widthwise ends generally perpendicular to the front and rear sides, a pair of flanged lengthwise ends generally perpendicular to the front and back sides, a pair of inner flanges extending from the front side and being generally parallel and adjacent to a corresponding one of the flanged lengthwise ends so as to define a channel between the inner flange and corresponding flanged lengthwise end wherein each inner flange has at least one cut-out therein. The back panel further includes at least one male engagement region adjacent each flanged widthwise end. In one embodiment, each of the male engagement regions comprising a half-round bump having a perimetrical edge.

Each side panel has an interior side corresponding to the front side of the back panel and an exterior side corresponding to the rear side of the back panel. Each side panel has a pair of widthwise ends, a front flanged lengthwise end portion, and a rear flanged lengthwise end portion. The rear flanged lengthwise end is sized for frictional insertion into a corresponding channel of the back panel. Each flanged lengthwise end portion of each side panel has a first portion extending from the interior side and being generally perpendicular to the interior side of the side panel and a second portion that is attached and generally perpendicular to the first portion. The second portion extends generally parallel to and confronts the interior side. The second portion of the rear flanged lengthwise end portion has at least one cut-out therein that is generally aligned with the cut-out in a corresponding one of the inner flanges of the back panel. The second portion of the front flanged lengthwise portion has a cut-out therein. Each side panel has at least one male engagement region located on the exterior side and adjacent a corresponding widthwise end of the side panel. In one embodiment, each male engagement region comprises a half round bump that has a perimetrical edge.

The top panel has a top side, a bottom side, a pair of flanged widthwise ends and a pair of flanged lengthwise ends. The top panel has at least one female engagement region on each flanged lengthwise and widthwise end. Each female engagement region corresponds to one of the male engagement regions on the back panel and side panels. In one embodiment, each female engagement region comprises an opening having a perimetrical edge;

The bottom panel has a top side, a bottom side, a pair of flanged widthwise ends and a pair of flanged lengthwise ends. The bottom panel has at least one female engagement region on each flanged lengthwise and widthwise end thereof. Each female engagement region on the flanged lengthwise and widthwise ends of the bottom panel corresponds to one of the male engagement regions on the back panel and side panels. In one embodiment, each female engagement region on the flanged lengthwise and widthwise ends of the bottom panel comprises an opening having a perimetrical edge.

The shelf member having a top side, a bottom side, a pair of widthwise end portions, a front flanged lengthwise end portion, and a rear flanged lengthwise end portion. Each of the flanged lengthwise end portions has a first portion generally perpendicular to the bottom side of the shelf member and a second portion attached to and generally perpendicular to the first portion and which confronts the bottom side. The second portion of the front flanged lengthwise end portion of the shelf member has a pair of cut-outs. Each of the cut-outs being located in proximity to a corresponding widthwise end of the shelf member.

The quick assembly storage unit further includes at least one shelf support member that is attached to the back panel and defines a region that is sized for frictionally receiving a portion of the rear flanged lengthwise end portion of the shelf member.

The side panels are configured to be attached to the back panel such that the rear flanged lengthwise end portion of each side panel is frictionally inserted into a corresponding channel of the back panel such that the interior sides of the side panels face each other and the cut-outs of the rear flanged lengthwise end portions of the side panel are generally aligned with the cut-outs of the inner flanges. The back panel and the side panels attached to the back panel define an intermediate assembly.

The top panel is configured to be attached to the back and side panels wherein the perimetrical edge of each half round bump on the side and back panels extends through a corresponding one of the openings on the top panel. The top panel is sized, in relation to the intermediate assembly, so as to allow a tight-fitting relationship between the top panel and the side and back panels and to allow the perimetrical edge of each half round bump to firmly abut the perimetrical edge of a corresponding opening on the top panel.

The bottom panel is configured to be attached to the back and side panels wherein the perimetrical edge of each half round bump on the side and back panels extends through a corresponding one of the openings on the bottom panel. The bottom panel is sized, in relation to the intermediate assembly, so as to allow a tight-fitting relationship between the bottom panel and the side and back panels and to allow the perimetrical edge of each half round bump to firmly abut the perimetrical edge of a corresponding opening on the bottom panel.

The shelf member is configured to be removably attached to the side panels and back panel wherein portions of the rear flanged lengthwise end portion that are adjacent to the widthwise ends of the shelf member are received by the cut-outs in the inner flanges and the rear flanged lengthwise end portions of the side panels and wherein a portion of the rear flanged lengthwise end portion of the shelf member is frictionally disposed in the region of the shelf support member.

The particular structures of-the back, side, top, and bottom panels provide a tight-fitting relationship between all interconnecting panels, and the particular structure of the shelf members provides a tight-fitting relationship between each shelf member and the side panels and between each shelf member and the back panel thereby providing the quick-assembly a storage unit with a relatively high degree of structural integrity.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 5A is a partial side-elevational exploded view illustrating the manner in which the top panel of FIG. 5 is attached to the side panels of FIGS. 1 and 3.

FIG. 5B is a partial, side-elevational exploded view showing the top and side panels of FIG. 5A connected together.

FIG. 9 is a bottom plan view of a shelf member shown in FIG. 1.

FIG. 10 is a front view of the shelf member of FIG. 9.

FIG. 11 is a view taken along line 11—11 in FIG. 9.

DESCRIPTION OF THE PREFERRED EMBODIMENT

In describing the preferred embodiments of the present invention, reference will be made herein to FIGS. 1–12 of the drawings in which like numerals refer to like features of the invention.

Figure 1:
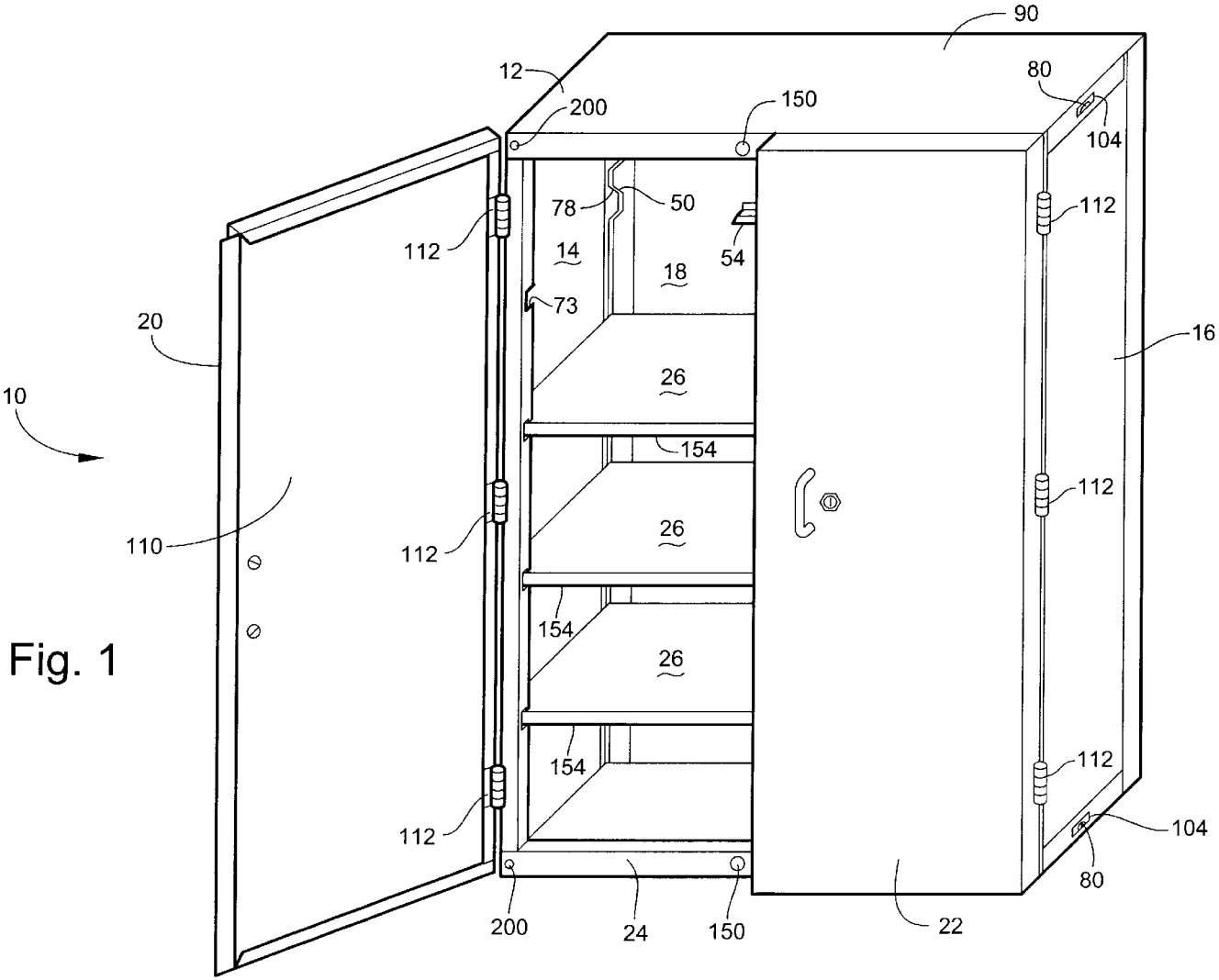
FIG. 1 is a perspective view of the quick-assembly storage unit of the present invention.

Referring to FIG. 1, there is shown quick-assembly storage unit 10 of the present invention. Storage unit 10 can be configured as a storage cabinet, storage box or any other type of container that can be used for storing items. Storage unit 10 generally comprises top panel 12, side panels 14 and 16, back panel 18, door panels 20 and 22, bottom panel 24 and shelves 26. In one embodiment, door panels 20 and 22 are not utilized.

In order to facilitate understanding of the present invention, each component of storage unit 10 is described in detail in the ensuing description.

1) The Back Panel

Figure 2:
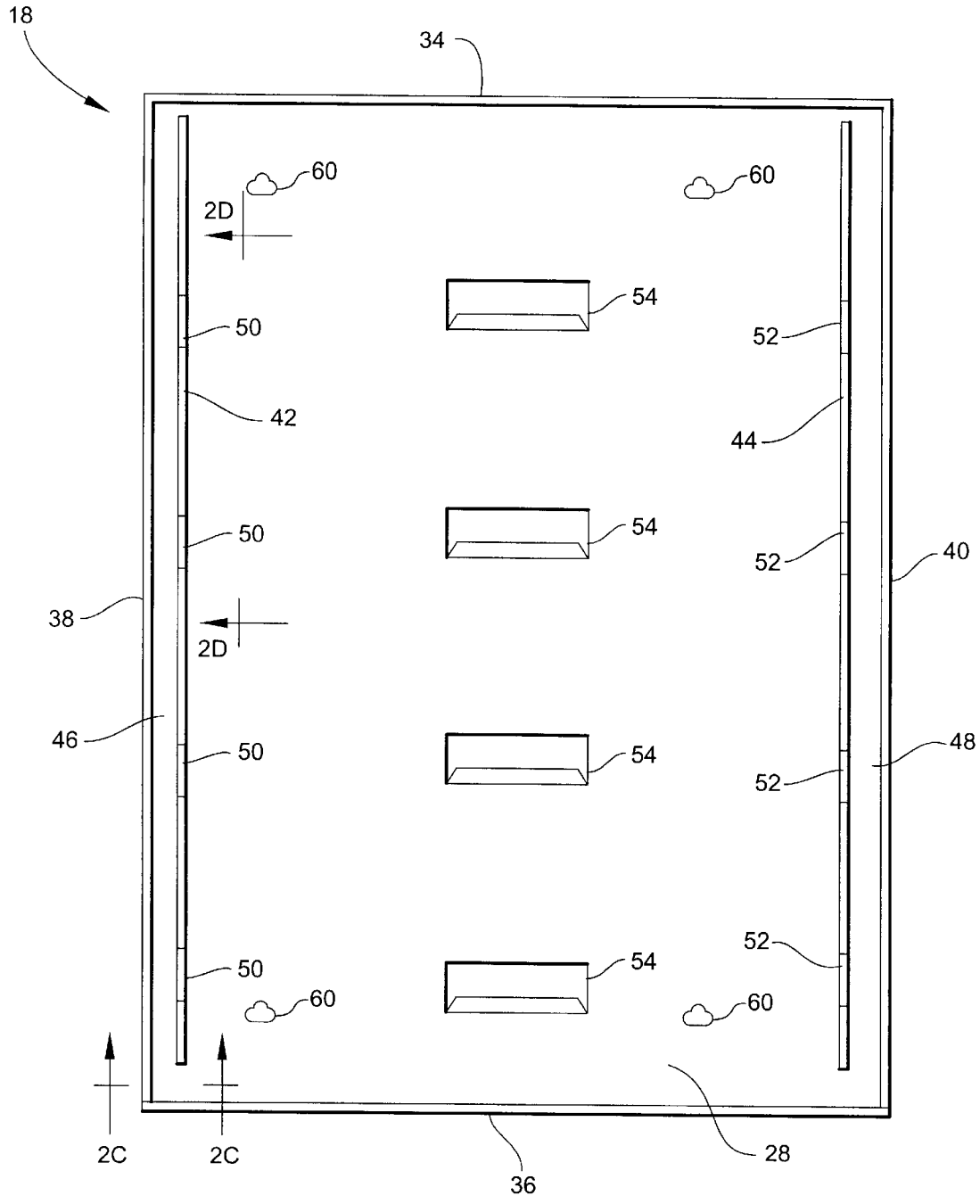
FIG. 2 is a front elevational view of a back panel of the quick-assembly storage unit of the present invention.
Figure 4:
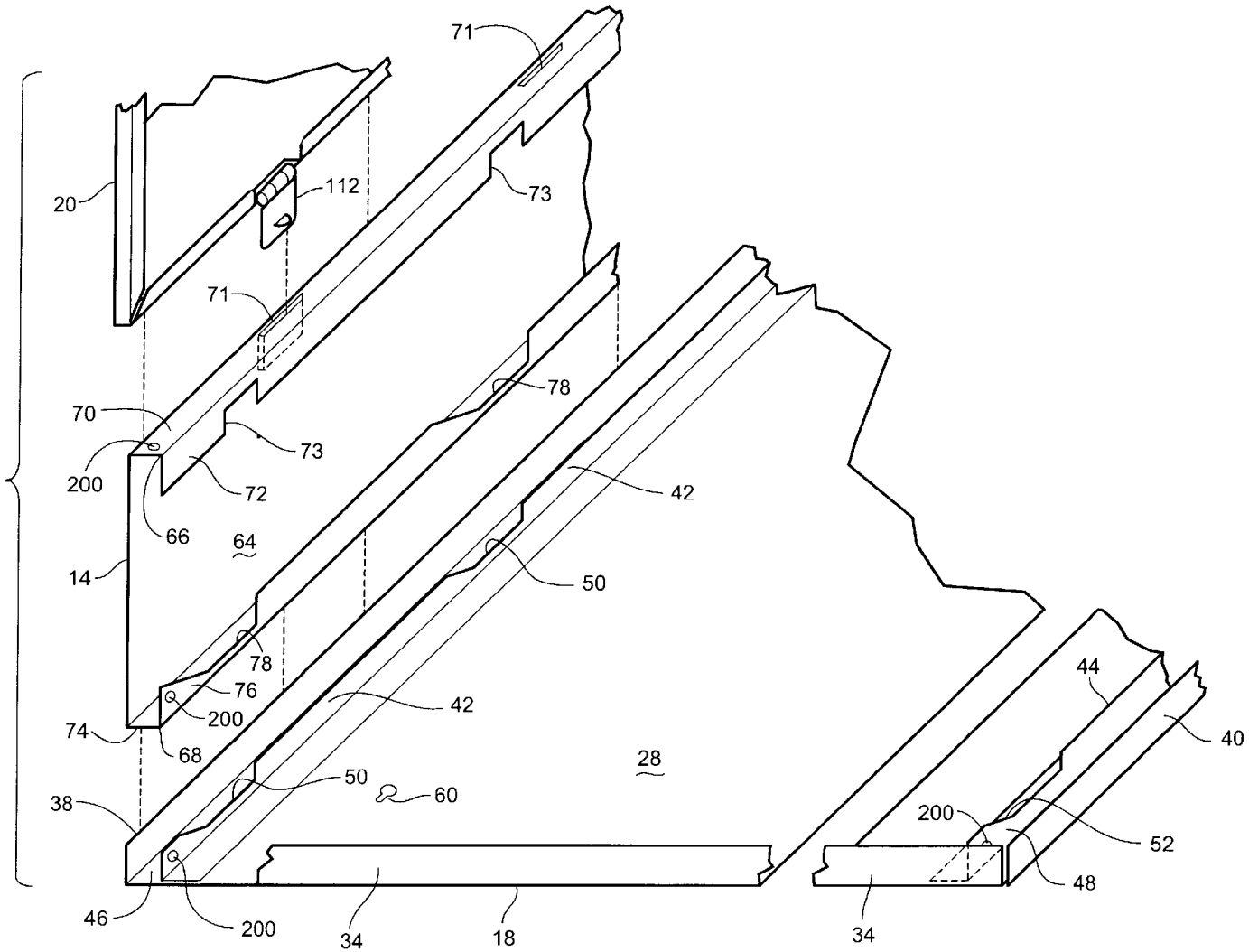
FIG. 4 is an exploded view illustrating the connection of the door, side and back panels of the quick-assembly storage unit of FIG. 1.
Figure 7:
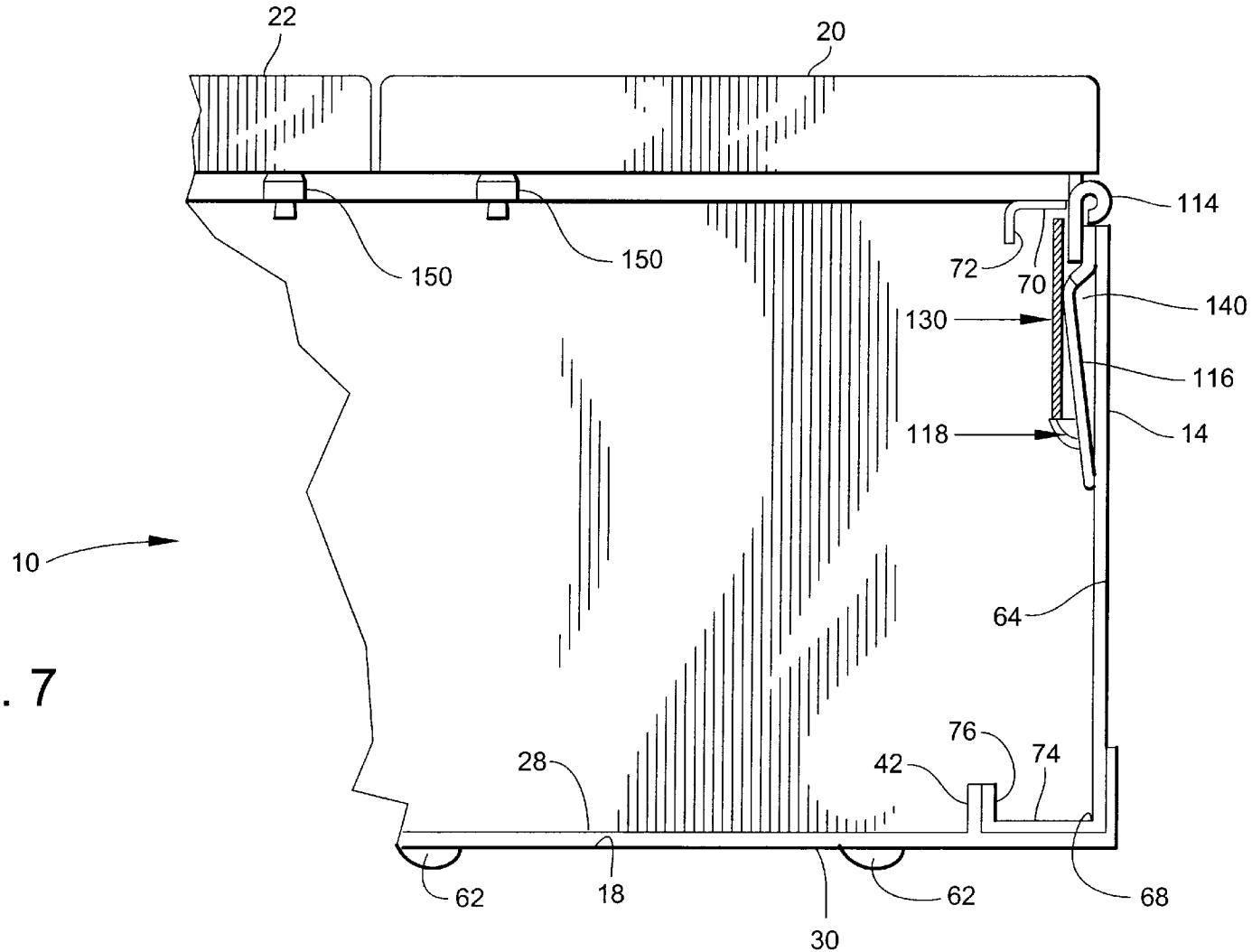
FIG. 7 is a partial view looking downward into the partially assembled storage unit of the present invention without the top panel or shelf members being shown in order to facilitate viewing the attachment of a door panel to a side panel, the retainer clip of FIGS. 6C being shown in cross-section.

Referring to FIGS. 2 and 4, back panel 18 generally comprises front side 28 and rear side 30 (shown in FIG. 7). Back panel 18 includes flanged widthwise ends 34 and 36 and flanged lengthwise ends 38 and 40. Back panel 18 further includes flange portion or member 42 that is attached to and extends from front side 28. Flange portion 42 is in proximity and generally parallel to lengthwise end 38. Back panel 18 also includes similar flange portion or member 44 that is attached to and extends from front side 28. Flange portion 44 is in proximity and generally parallel to lengthwise end 40. Referring to FIGS. 2, 2C and 2D, flanged portion 42 is spaced apart from flanged lengthwise end 38 by a predetermined distance. Similarly, flanged portion 44 is spaced apart from flanged lengthwise end 40 by a predetermined distance. Lengthwise end 38 and flanged portion 42 define a channel 46. Similarly, lengthwise end 40 and flanged portion 44 define a channel 48. The purpose of channels 46 and 48 is discussed in the ensuing description.

In a preferred embodiment, flange portions 42 and 44 extend for substantially the entire length of lengthwise ends 38 and 40. Flange portion 42 includes cut-outs or notches 50. In a preferred embodiment, cut-outs 50 are equidistantly spaced apart. Similarly, flange portion 44 includes cut-outs or notches 52 (see FIG. 2). The purpose of cut-outs 50 and 52 is discussed in the ensuing description. In an alternate embodiment, each flanged portion 42 and 44 comprises segmented flanged portions that are equidistantly spaced rather than one continuous flanged portion.

Figure 2B:
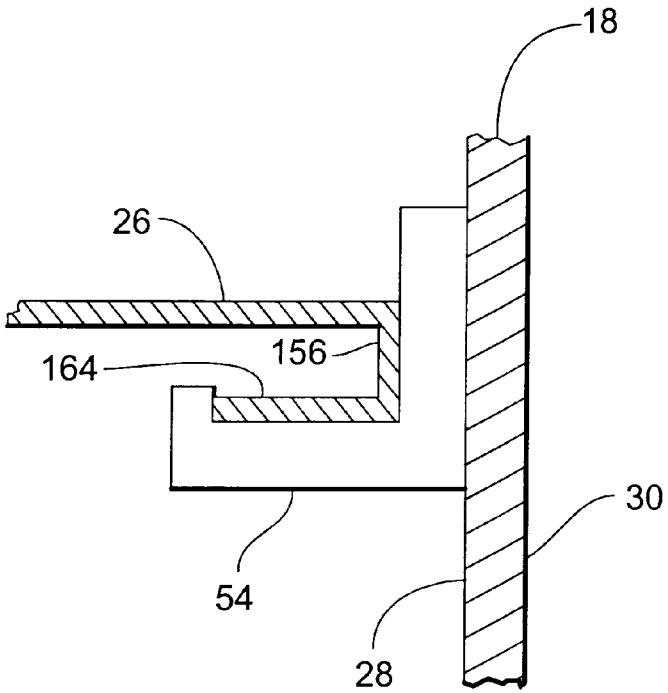
FIG. 2B is a side elevational view, partially in cross-section, showing a shelf member, depicted in FIG. 1, supported by the shelf support bracket of FIG. 2A.
Figure 2A:
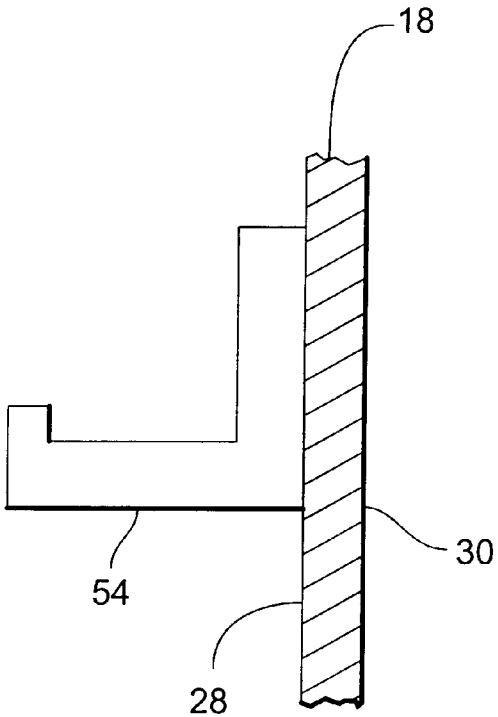
FIG. 2A is an elevational view, partially in cross-section, showing a shelf support bracket depicted in FIG. 2.
Figure 2C:
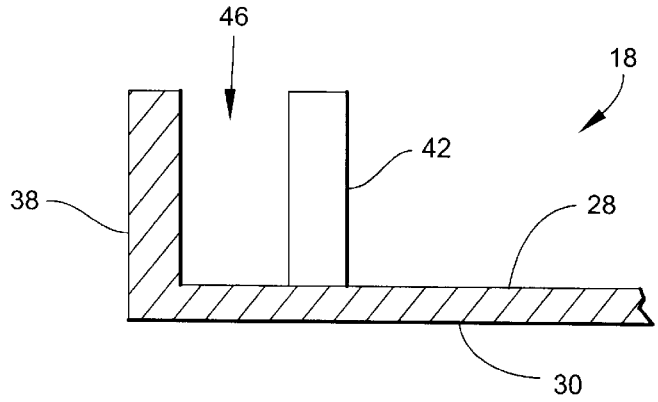
FIG. 2C is a view, partially in cross-section, taken along line 2C—2C in FIG. 2.
Figure 2D:
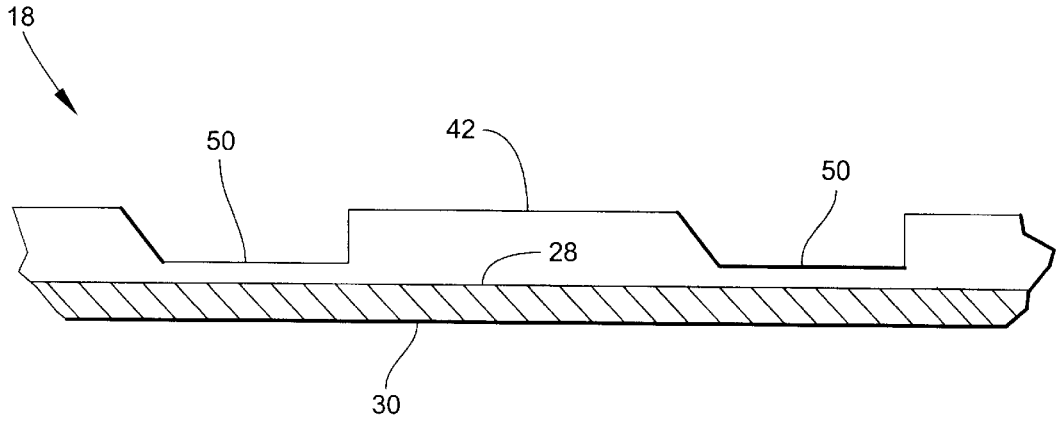
FIG. 2D is view, partially in cross-section, taken along line 2D—2D in FIG. 2.

Referring to FIGS. 2, 2A and 2B, back panel 18 further includes shelf support brackets 54 that attached to side 28 of back panel 18. Brackets 54 support shelves 26. In one embodiment, brackets 54 are configured as generally "L" shaped members and are rigidly attached to back panel 18. Back panel 18 includes keyholes or openings 60 that enable storage unit 10 to be secured to hooks, screws, nails, etc. that are fixed to a wall or other structural member.

Figure 12:
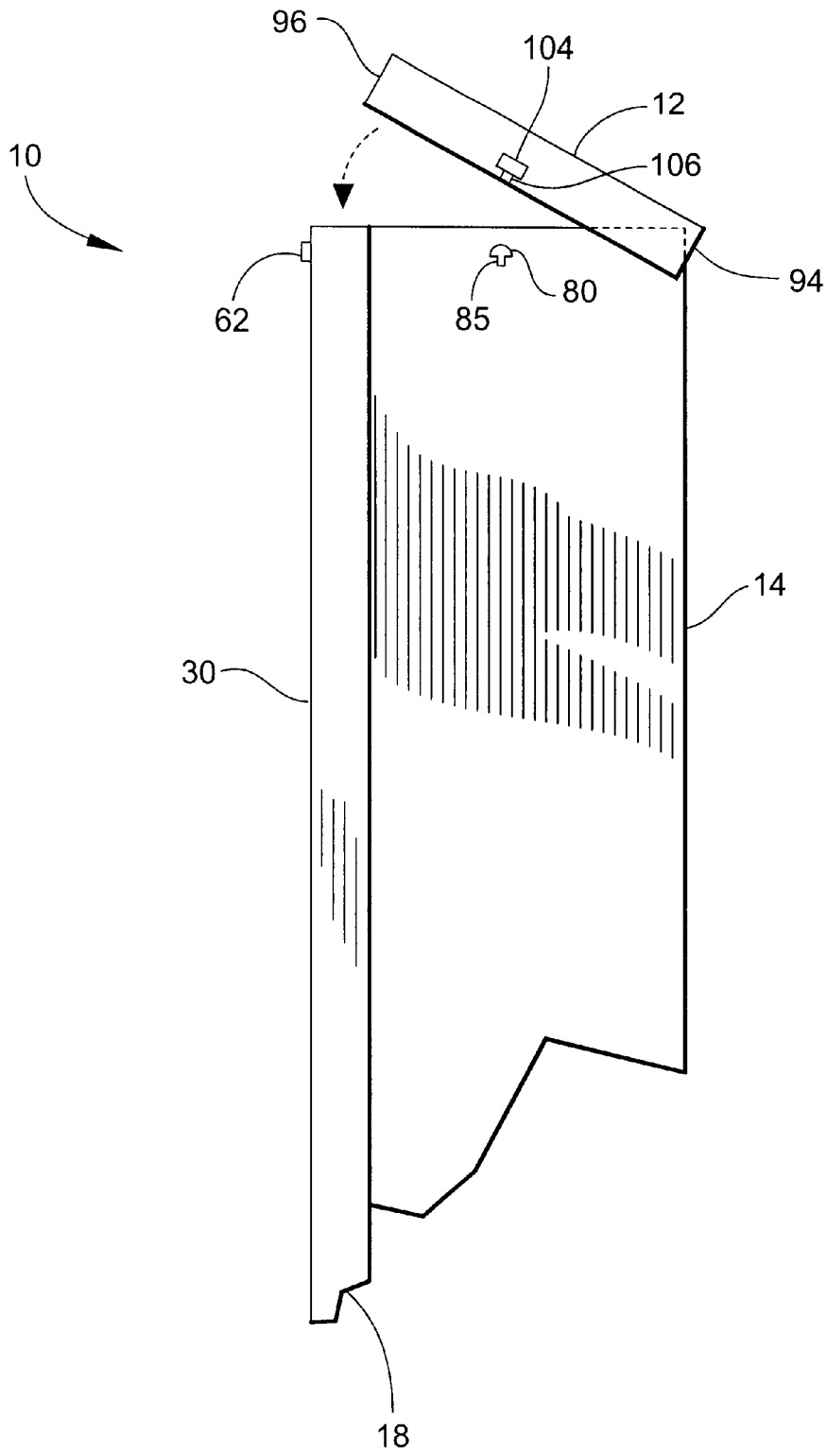
FIG. 12 is a partial, side elevational view illustrating the interconnection of the top, side and back panels of the quick-assembly storage unit of FIG. 1.

Referring to. FIGS. 7 and 12, back panel 18 includes protrusions 62 that are formed on the rear side 30 of back panel 18. In one embodiment, each protrusion 62 is formed by the creation of what is known as a "half-round bump" or "half-round protrusion". In order to create such a bump or protrusion, a round or circular protrusion or bump is made in the sheet of metal from which back panel 18 is fabricated. The protrusion or bump is then cut at is midpoint, i.e. across the diameter. One half of the protrusion or bump is hammered or flattened while the remaining half remains intact. The half that remains becomes the half-round bump and includes an edge resulting from the flattening of the other half of the bump. Half-round bumps are described in commonly owned U.S. Pat. No. 6,076,908, the disclosure of which is herein incorporated by reference. Protrusions 62 are used to attach top and bottom panels 12 and 24, respectively, to back panel 18. Back panel 18 further includes a recess or crevice 63 adjacent to each protrusion 62. The purpose of protrusions 62 and the corresponding recesses 63 is discussed in the ensuing description.

In an alternate embodiment, protrusions 62 are separate pieces that are attached to rear side 30 of back panel 18.

2) The Side Panels

Figure 3:
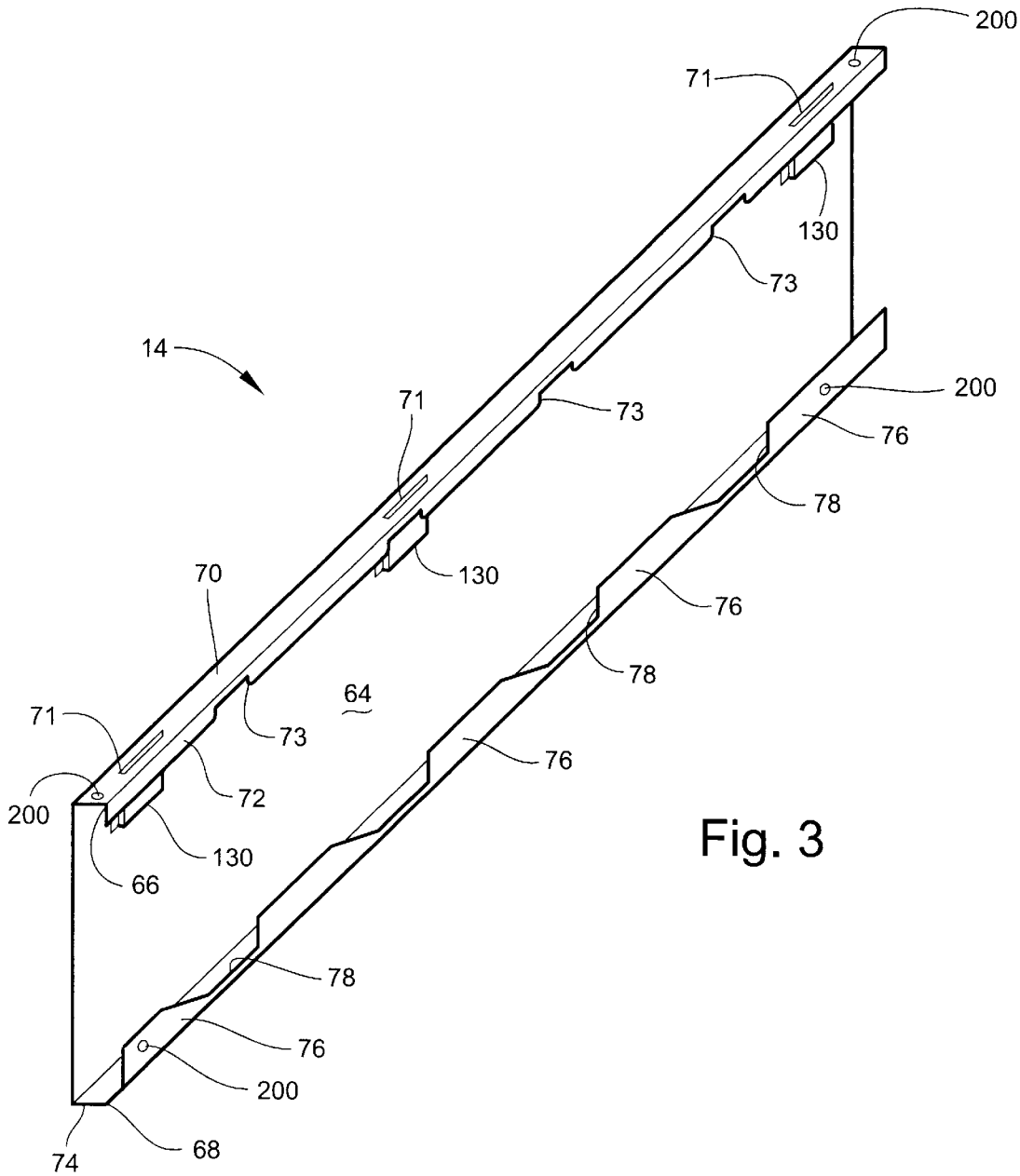
FIG. 3 is a perspective view of a side panel depicted in FIG. 1.

Referring to FIGS. 1, 3 and 4, side panels 14 and 16 are substantially identical in construction. Therefore, for purposes of brevity, only side panel 14 is described in the ensuing description. Side panel 14 generally comprises an interior side 64 and an exterior side (not shown) that is opposite interior side 64. Side panel 14 includes longitudinally extending end portions 66 and 68. End portion 66 comprises portion 70, which is angulated with respect to interior side 64, and portion 72 which is angulated with respect to portion 70. In a preferred embodiment, portion 70 is substantially perpendicular to interior side 64, and portion 72 is substantially perpendicular to portion 70. Portion 70 has a plurality of slots 71 formed therein. Portion 72 has a plurality of cut-outs 73. The purposes of slots 71 and cut-outs 73 are discussed in the ensuing description. Similarly, end portion 68 comprises portion 74, which is angulated with respect to interior side 64, and portion 76 which is angulated with respect to portion 74. In a preferred embodiment, portion 74 is substantially perpendicular to interior side 64, and portion 76 is substantially perpendicular to portion 74. Portion 76 has a plurality of cut-outs 78. The purpose of cut-outs 78 is discussed in the ensuing description.

Referring to FIGS. 3 and 4, lengthwise end portion 68 is sized for frictional insertion into channel 46 of back panel 18. Once lengthwise end portion 68 is completely inserted into channel 46, side panel 14 becomes firmly attached to back panel 18.

Figure 5:
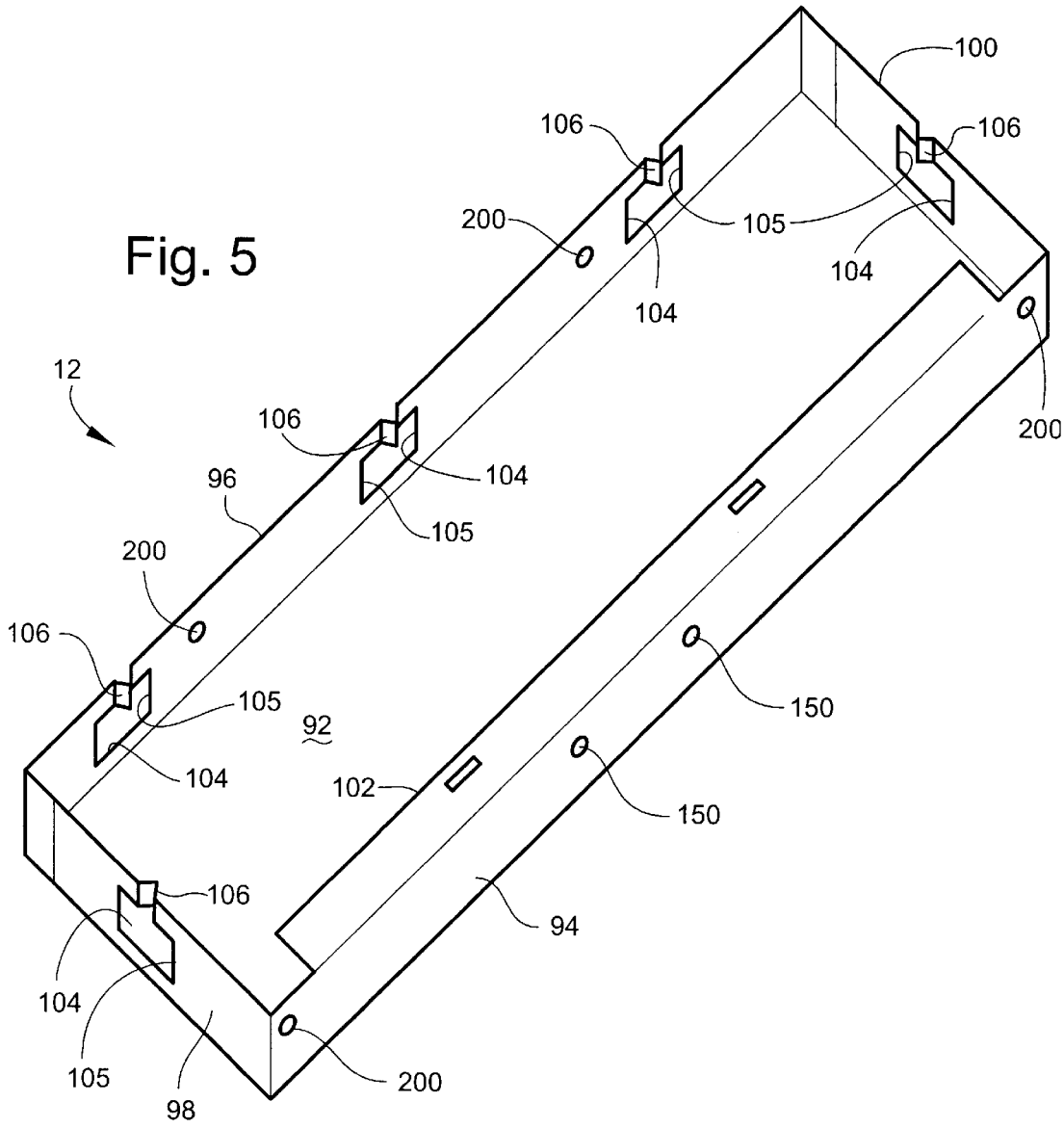
FIG. 5 is a perspective view of a top panel of the quick-assembly storage unit of the present invention, the bottom panel of the quick-assembly storage unit of the present invention being essentially the same.
Figure 5C:
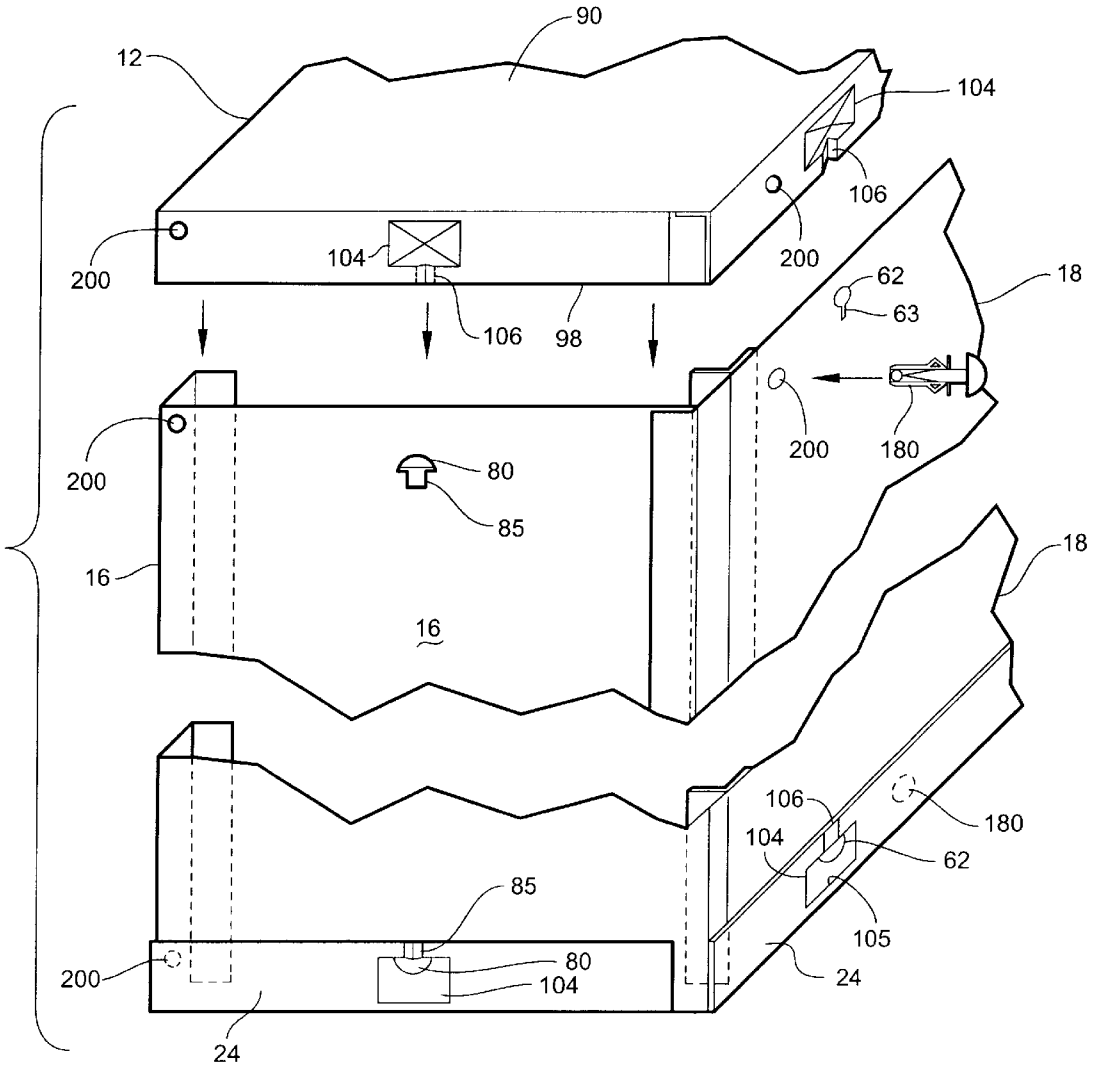
FIG. 5C is a partial, exploded view, in perspective, illustrating the manner in which the top panel of FIG. 5 is attached to the side and back panels of FIGS. 1, 3 and 5, and showing the bottom panel, depicted in FIG. 1, attached to the side and back panels.

Referring to FIGS. 5A, 5B and 5C, side panel 14 further includes protrusions 80. In one embodiment, protrusions 80 are configured as half-round bumps which were described in the foregoing description. Protrusion 80 has a rounded-portion 82 and edge 84. Side panel 14 further includes recess or crevice 85 below each protrusion 80. The purpose of protrusions 80 and recess 85 is discussed in the ensuing description.

Side panel 16 is attached to back panel 18 in the same manner. Specifically, the appropriate lengthwise end portion of side panel 16 is frictionally inserted into channel 48 of back panel 18.

3) Top and Bottom Panels

Top and bottom panels 12 and 24, respectively, are substantially the same in construction. Thus, for purposes of brevity, only top panel 12 is described in the ensuing description. Referring to FIGS. 1, 5, 5A, 5B and 5C, top panel 12 generally comprises exterior side 90, interior side 92, flanged lengthwise ends 94 and 96 and flanged widthwise ends 98 and 100. Lengthwise end 94 includes flange portion 102 that is attached and generally perpendicular to end 14. When storage unit 10 is completely assembled, door panels 20 and 22 are adjacent to flange portion 102 when door panels 20 and 22 are completely closed. Lengthwise ends 94 and 96 and widthwise ends 98 and 100 have openings 104. Each opening 104 has a perimetrical edge 105. In one embodiment, openings 104 have a generally rectangular shape. However, other suitable shapes can be used as well. As shown in FIG. 5, top panel 12 further includes protrusions 106 that are adjacent to openings 104. In one embodiment, protrusions 106 have a generally triangular shape. Protrusions 106 are sized to snugly fit into recesses 85 on side panel 14 (see FIG. 5A) and the corresponding recesses 63 that are adjacent to protrusions 62 on back panel 18 and corresponding recesses (not shown) on side panel 16.

Referring to FIGS. 5A, 5B and 5C, top panel 12 is sized so that when top panel 12 is being attached to side panels 14 and 16 and back panel 18, widthwise ends 98 and 100 of top panel 12 contact the exterior sides of side panels 14 and 16, and back panel 18, protrusions 106 frictionally slide over protrusions 80 and snap into recesses 63 and 85. When each protrusion 106 is positioned within a corresponding recess 63 or 85, each protrusion 80 is completely positioned within a corresponding opening 104 and each edge 105 of each opening 104 abuts either edge 84 of a corresponding protrusion 80 or the edge (not shown) of a corresponding protrusion 62. As a result, top panel 12 is firmly attached to side panels 12 and 16 and back panel 18.

4) The Door Panels

Figures 6A, 6B, 6C, 6D:
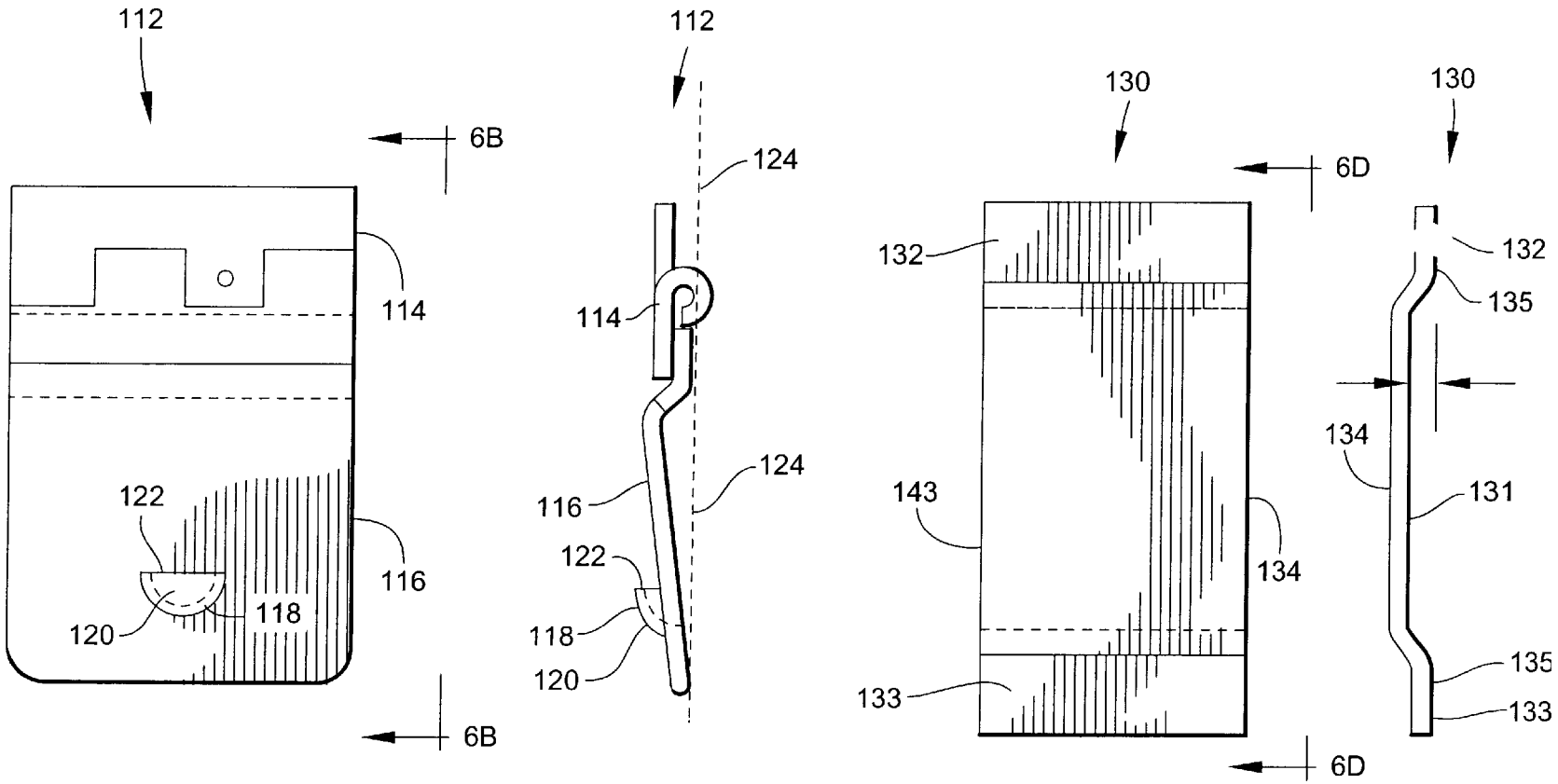
FIG. 6A is a plan view of a hinge push-plate depicted in FIGS. 3 and 4.
FIG. 6B is a view taken along line 6B—6B in FIG. 6A.
FIG. 6C is a plan view of a retainer-clip depicted in FIG. 3.
FIG. 6D is a view taken along line 6D—6D in FIG. 6C.
Figure 8:
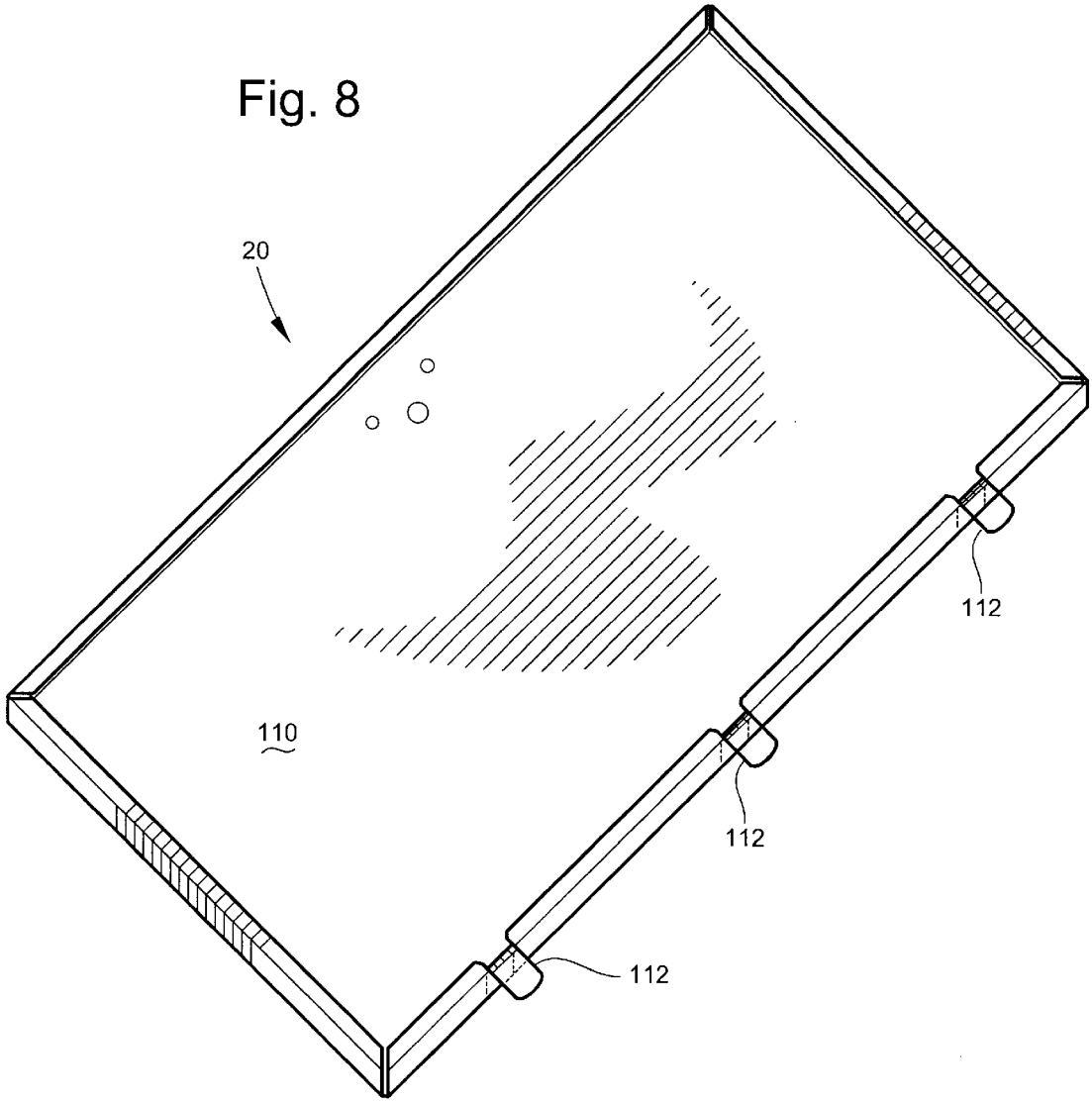
FIG. 8 is a perspective view of a door panel shown in FIG. 1.

Referring to FIG. 1, door panels 20 and 22 are substantially identical in construction. Furthermore, door panels 20 and 22 are attached to side panels 14 and 16 in an identical manner. Therefore, for purposes of brevity, only door panel 20 is described in the ensuing description. Referring to FIGS. 1 and 8, door panel 20 has an interior side 110 and an exterior side (not shown) that is opposite interior side 110. Referring to FIGS. 6A–6D, door panel 20 includes hinged push plates. 112 attached thereto. Each hinged push plate 112 comprises hinge portion 114 and plate portion 116. Plate portion 116 includes protrusion 118. Protrusion 118 comprises rounded-portion 120 and edge portion 122. In a preferred embodiment, protrusion 118 is configured as a half-round bump that was described in the ensuing description. As shown in FIG. 6B, plate portion 116 is angulated with respect to reference plane 124 (indicated by the dotted line). The purpose of such a configuration is described in the ensuing description. Referring to FIGS. 3 and 4, in order to movably attach door panels 20 and 22 to side panels 14 and 16, respectively, retainer clips 130 are, attached to the interior sides of side panels 14 and 16 adjacent slots 71 formed in side panels 14 and 16. Retainer clip 130 can be attached by any suitable means, e.g. fasteners, rivets, screws, spot welding, etc. However, it is to be understood that retainer clips 130 are attached to side panels 14 and 16 prior to storage unit 10 being shipped to the end user or consumer.

Figure 6E:
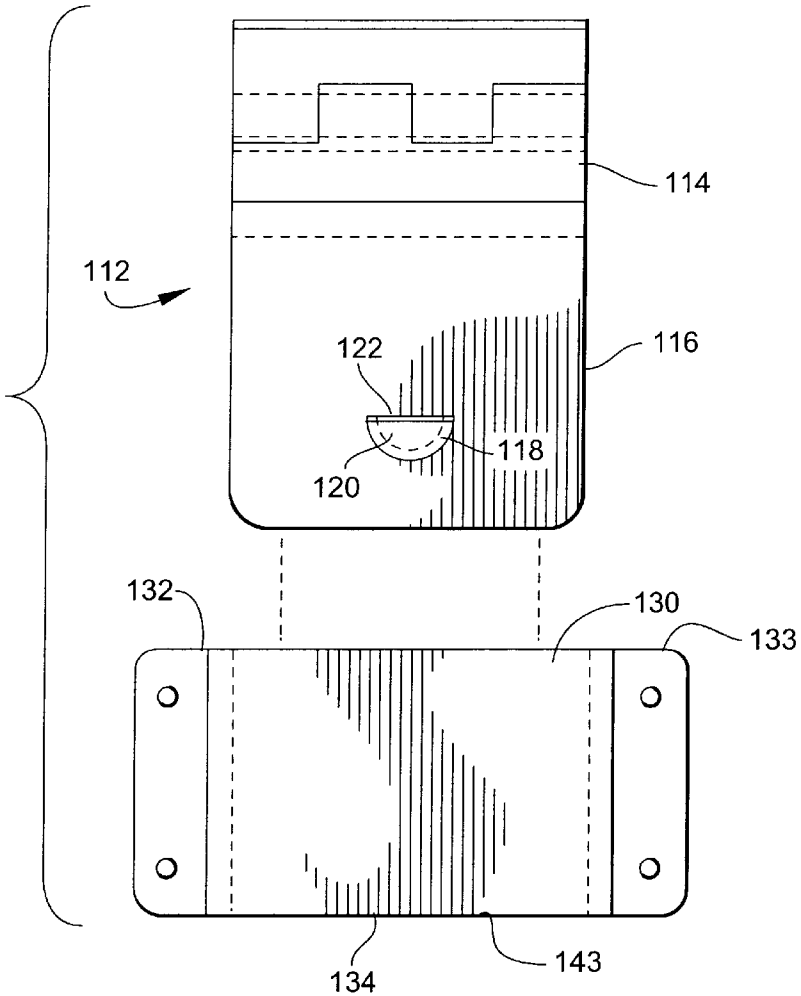
FIG. 6E is exploded view illustrating the manner in which the hinge push-plate of FIG. 6A is interlocked with the retainer clip of FIG. 6C.
Figure 6F:
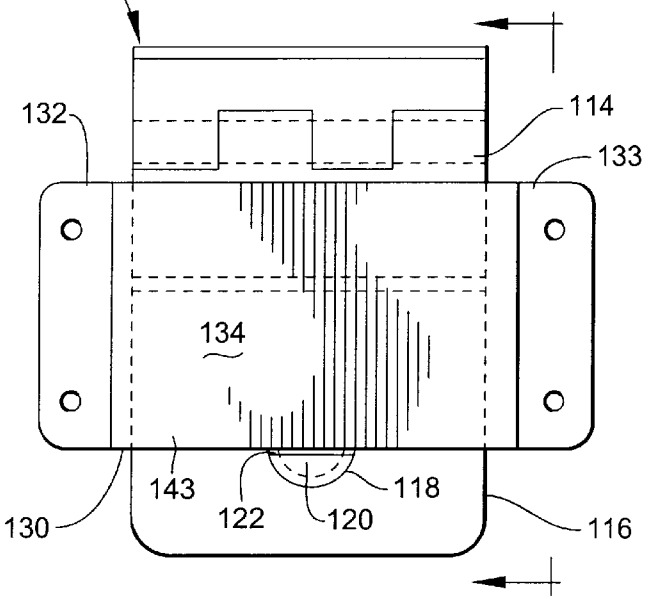
FIG. 6F is plan view showing the hinge push-plate interlocked with the retainer clip, both of which being shown in FIG. 6E.

As shown in FIG. 6D, clip retainer 130 comprises rear side 131, end portions 132 and 133 that are separated by central portion 134. End portions 132 and 133 have contact surfaces 135 that contact the interior side of side panels 14 and 16. Central portion 134 is angulated with respect to end portions 132 and 133. Such a configuration provides a space within which to insert plate portion 116. This is illustrated in FIGS. 6E, 6F and 7. Surfaces 135 of end portions 132 and 133 contact and are flush with the interior sides of side panels 14 and 16. Since central portion 134 is angulated with respect to end portions 132 and 133, space 140 is created between central portion 134 and the interior side 64 of side panel 14. Plate portion 116 is then inserted into space 140. Protrusion 118 and the angulation of central portion 134 cooperate to provide a frictional relationship between protrusion 118 and rear side 131 of central portion 134 as plate portion 116 is being inserted into space 140. Plate portion 116 is inserted through space 140 until protrusion 118 exits space 140 and edge 122 of protrusion 118 abuts perimetrical edge 143 of central portion 134 of clip retainer 130. Protrusion 118 and the angulation of central portion 134 effect a firm lodgment of plate portion 116 within space 140 when plate portion 116 is completely inserted into space 140, as shown in FIG. 6F. As shown in FIGS. 7–9, hinge portion 114 of each hinge push plate 112 is attached to door panel 20 thereby enabling door panel 20 to swing open or close. Since hinge push plate 112 is firmly positioned within space 140, door panel 20 does not become dislodged, loose or misaligned.

Hinge portions 114 can be attached to door panels 20 and 22 by any suitable means, e.g. fasteners, rivets, screws, spot welding. However, it is to be understood that hinge push plates 112 are already attached to the door panels 20 and 22 prior to storage unit 10 being shipped to the end user or consumer.

In a preferred embodiment, rubber or plastic bumpers 150 (see FIGS. 1 and 7) are attached to the top and bottom panels 12 and 24 so as to function as door stops which reduce noise and cushion the impact when door panels 20 and 22 are closed.

5) Shelf Members

Referring to FIG. 1, shelf members 26 are removably secured to side panels 14 and 16 and back panel 18. Shelf members 26 are identically constructed. Referring to FIGS. 9–11, each shelf member 26 comprises top side 151 for receiving stored articles, items, etc., bottom side 152, lengthwise end portions 154 and 156, and widthwise end portions 158 and 160. Lengthwise end portions 154 and 156 include flange portions 162 and 164, respectively. Flange portion 162 includes cut-outs 170. Shelf members 26 are inserted into storage unit 10 and secured to side panels 14, 16 and back panel 18 so that lengthwise end portion 156 is supported by a bracket 54 (see FIG. 2B), a portion of lengthwise end portion 156 is positioned within cut-outs 78 of side panel 14 (and corresponding cut-outs of side panel 16) and cut-outs 50 of back panel 18, and cut-out 170 of shelf member 26 receives the perimetrical edge of cut-out 73 of side panel 14 (as well as the corresponding cut-outs of side panel 16). The structural configurations of side panels 14, 16, back panel 18 and shelf member 26 described in the foregoing description provide for firm placement or lodgment of shelf members 26 within storage unit 10. Furthermore, once shelf members 26 are secured to side panels 14, 16 and back panel 18, shelf members 26 significantly improve the overall structural integrity of storage unit 10.

In one embodiment, push rivets, such as push rivet 180 shown in FIG. 5C, are used to further improve the structural integrity of storage unit 10. Referring to FIGS. 1, 4 and 5C, push rivets 180 are inserted through openings 200 that are located on the front and rear sides of top and bottom panels 12 and 24, respectively, and in back panel 18 and side panels 14 and 16. Push rivets 180 lock together side panels 14 and 16, back panel 18 and top and bottom panels 12 and 24, respectively.

Storage unit 10 is preferably assembled in the following manner:

a) back panel 18 is positioned on a flat surface with interior side 28 facing upward;

b) side panel 14 is attached to back panel 18 as described in the foregoing description;

c) side panel 16 is attached to back panel 18 as described in the foregoing description;

d) push rivets 180 are inserted into openings 200 in the back panel 18 and flange 76 of side panel 14 and into openings 200 of the corresponding flange of side panel 16 in order to lock the side panels 14 and 16 to back panel 18 (see FIG. 4);

e) top panel 12 is positioned over side panels 14 and 16 and back panel 18 as shown in FIG. 12;

f) top panel 12 is then snapped securely into place such that protrusions 62 and 80 are disposed within openings 104 (the user may grasp one of brackets 54 for support during this step);

g) the bottom most shelf member 26 is inserted as described in the foregoing description;

h) the remaining shelf members 26 are inserted in the same manner;

i) bottom panel 24 is positioned over side panels 14 and 16 and back panel 18 in the same manners as was done for top panel 12 and snapped securely into place such that protrusions 62 and 80 are disposed with the openings formed in bottom panel 24 (the openings being similar to openings 104 of top panel 12);

j) push rivets 180 are inserted into openings 200 in the front sides of top and bottom panels 12 and 24, respectively, and in lengthwise end portion 66 of side panel 14 and the corresponding lengthwise end portion of side panel 16 so as to lock storage unit 10 together (see FIGS. 1 and 4);

k) flour rubber door bumpers 150 are attached as shown in FIGS. 1 and 7;

l) door panel 20 is positioned so that plate portion 116 of each hinge push plate 112 is aligned with a corresponding slot 71 of side panel 14;

m) a downward force is exerted on door panel 20 so that plate portions 116 are inserted into spaces 140 and plate portions 116 become locked into place as described in the ensuing description;

n) the previous steps are repeated for door panel 22;

o) storage unit 10 is then positioned so that it is upright; and p) push rivets 180 are inserted into openings 200 in the rear sides of top and bottom panels 12 and 24, respectively, and back panel 18 as shown in FIG. 5C.

In a preferred embodiment, storage unit 10 is mounted to a flat surface such as a wall or other structural member by using keyholes 60 in back panel 18.

Storage unit 10 can be manufactured from a variety of materials, e.g. metal, plastic etc.

Thus, storage unit 10 can be shipped in a disassembled state and then quickly assembled by the consumer or end user. In addition to solving the problems associated with the prior art storage units, storage unit 10 can be assembled by the consumer or end user with a minimal amount of tools.

The relatively high degree of structural integrity of the completely assembled storage unit 10 eliminates the need to use additional fastening devices (e.g. screws, rivets, etc.). However, if the user or consumer desires, such additional fasteners can be used to further strengthen the completely assembled storage unit 10.

In one embodiment, quick-assembly storage unit 10 includes a locking device, latch, magnets or other mechanism to keep door panels 20 and 22 in a closed position when the user desires that the door panels be kept in a closed position.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A quick-assembly storage unit, comprising:

a back panel having a front side, back side, a pair of flanged widthwise ends generally perpendicular to the front and back sides, a pair of flanged lengthwise ends generally perpendicular to the front and back sides, a pair of inner flanges extending from the front side and being generally parallel and adjacent to a corresponding one of the flanged lengthwise ends so as to define a channel between the inner flange and corresponding flanged lengthwise end, each inner flange having at least one cut-out therein, the back panel further including at least one male engagement region adjacent each flanged widthwise end, each of the male engagement regions comprising a half-round bump having a perimetrical edge;

a pair of side panels, each side panel having an interior side corresponding to the front side of the back panel and an exterior side corresponding to the back side of the back panel, each side panel having a pair of widthwise ends, a front flanged lengthwise end portion, and a rear flanged lengthwise end portion, the rear flanged lengthwise end being sized for frictional insertion into a corresponding channel of the back panel, each flanged lengthwise end portion of each side panel having a first portion extending from the interior side and being generally perpendicular to the interior side of the side panel and a second portion that is attached and generally perpendicular to the first portion, the second portion extending generally parallel to and confronting the interior side, the second portion of the rear flanged lengthwise end portion having at least one cut-out therein that is generally aligned with the cut-out in a corresponding one of the inner flanges of the back panel, the second portion of the front flanged lengthwise portion having a cut-out therein, each side panel having at least one male engagement region located on the exterior side and adjacent a corresponding widthwise end of the side panel, each male engagement region comprising a half round bump having a perimetrical edge;

a top panel having a top side, a bottom side, a pair of flanged widthwise ends and a pair of flanged lengthwise ends, the top panel having at least one female engagement region on each of the flanged lengthwise and widthwise ends, each female engagement region corresponding to one of the male engagement regions on the back panel, each female engagement region comprising an opening having a perimetrical edge;

a bottom panel having a top side, a bottom side, a pair of flanged widthwise ends and a pair of flanged lengthwise ends, the bottom panel having at least one female engagement region on each of the flanged lengthwise and widthwise ends, each female engagement region on the flanged lengthwise and widthwise ends corresponding to one of the male engagement regions on the back panel, each female engagement region on the flanged lengthwise and widthwise ends of the bottom panel comprising an opening having a perimetrical edge;

at least one shelf member, the shelf member having a top side, a bottom side, a pair of widthwise end portions, a front flanged lengthwise end portion, and a rear flanged lengthwise end portion, each of the flanged lengthwise end portions having a first portion generally perpendicular to the bottom side of the shelf member and a second portion attached to and generally perpendicular to the first portion and which confronts the bottom side, each second portion of the flanged lengthwise end portions having a pair of cut-outs, each cut-out being located proximate to a corresponding widthwise end of the shelf member;

at least one shelf support member attached to the back panel and defining a region that is sized for frictionally receiving a portion of the rear flanged lengthwise end portion of the shelf member;

said side panels being configured to be attached to said back panel wherein the rear flanged lengthwise end portion of each side panel is frictionally inserted into a corresponding channel of the back panel such that the interior sides of the side panels face each other and the cut-outs of the rear flanged lengthwise end portions of the side panels are generally aligned with the cut-outs of the inner flanges, said back panel and said side panels attached to said back panel defining an intermediate assembly;

said top panel being configured to be attached to said back panel and said side panels wherein the perimetrical edge of each half round bump on said back panel and said side panels extends through a corresponding one of the openings on said top panel, the top panel being sized, in relation to the intermediate assembly, so as to allow a tight-fitting relationship between said top panel and said back panel and said side panels thereby allowing the perimetrical edge of each half round bump to firmly abut the perimetrical edge of a corresponding opening on said top panel;

said bottom panel being configured to be attached to said back panel and said side panels such that the perimetrical edge of each half round bump on said back panel and said side panels extends through a corresponding one of the openings on said bottom panel, said bottom panel being sized, in relation to the intermediate assembly, so as to allow a tight-fitting relationship between said bottom panel and said back panel and said side panels thereby allowing the perimetrical edge of each half round bump to firmly abut the perimetrical edge of a corresponding opening on said bottom panel;

said shelf member being configured to be removably attached to the side panels and back panel wherein portions of the rear flanged lengthwise end portion that are adjacent to said widthwise ends of said shelf member are received by the cut-outs in said inner flanges and said rear flanged lengthwise end portions of said side panels and a portion of the rear flanged lengthwise end portion of said shelf member is frictionally disposed in said region of said shelf support member so as to provide a tight-fitting relationship between said shelf member and said side panels and between said shelf member and said back panel.

2. The quick-assembly storage unit according to claim 1 including fastening devices for further attaching the back panel to the rear flanged lengthwise end portions of the side panels.

3. The quick-assembly storage unit according to claim 2 wherein each of the fastening devices comprises a push rivet.

4. The quick-assembly storage unit according to claim 1 further including a pair of door panels hingedly attached to the front flanged lengthwise end portions.

5. The quick-assembly storage unit according to claim 4 each side panel has a pair of spaced apart slots in the first portion of the front flanged lengthwise end portion of the side panel, the quick assembly storage unit further comprising a plurality of clip retainers, each clip retainer having a perimetrical edge and being attached to the interior side of a corresponding side panel and configured so as to provide a space defined by the clip retainer and the interior side of the corresponding side panel, the space having an entry adjacent a corresponding slot and an exit opposite the entry.

6. The quick-assembly storage unit according to claim 5 wherein each door panel includes a hinge push plate attached thereto, each hinge push plate comprising a hinge portion attached to the door panel and a plate portion attached to the hinge portion, the plate portion having a protrusion extending therefrom, each plate portion being disposed within a corresponding slot and disposed within the space produced by a corresponding clip retainer and the interior side of the side panel to which the door panel is hingedly attached, the plate portion being configured so as to effect a tight-fitting and frictional relationship between the plate member and the clip retainer and between the plate member and the interior side of the side panel, the protrusion firmly abutting a portion of the perimetrical edge of the clip retainer that is adjacent to the exit of the space when the plate portion is fully disposed within the space thereby preventing the plate portion from being dislodged from the space.

7. The quick-assembly storage unit according to claim 6 wherein the protrusion comprises a half-round bump having a perimetrical edge which firmly abuts the perimetrical edge of the clip retainer when the plate portion is fully disposed within the space.

8. The quick-assembly storage unit according to claim 1 wherein each side panel and back panel has a plurality of recesses, each recess being adjacent to a corresponding male engagement region, and wherein the top panel has a plurality of protrusions, each protrusion of the top panel being adjacent a corresponding one of the female engagement regions of the top panel, the protrusions of the top panel being firmly positioned in the recesses of the side and back panels when the top panel is completely attached to the intermediate assembly.

9. The quick-assembly storage unit according to claim 1 wherein each side panel and back panel has a plurality of recesses, each recess being adjacent to a corresponding male engagement region, and wherein the bottom panel has a plurality of protrusions, each protrusion of the bottom panel being adjacent a corresponding one of the female engagement regions of the bottom panel, the protrusions of the bottom panel being firmly positioned in the recesses of the side and back panels when the bottom panel is completely attached to the intermediate assembly.

10. The quick-assembly storage unit according to claim 1 further comprising means for maintaining the door panels in a closed position.

* * * * *